US005460024A

United States Patent [19]

Meneghin et al.

[11] Patent Number: 5,460,024

[45] Date of Patent: Oct. 24, 1995

[54] APPARATUS FOR DRAWING AND IRONING METALLIC OR METALLOPLASTIC CANS

[75] Inventors: Rene Meneghin, Rives; Louis Trepied, Voreppe, both of France

[73] Assignee: American National Can Company, Chicago, Ill.

[21] Appl. No.: 167,957

[22] PCT Filed: May 4, 1992

[86] PCT No.: PCT/FR92/00403

§ 371 Date: Jun. 10, 1994

§ 102(e) Date: Jun. 10, 1994

[87] PCT Pub. No.: WO93/22079

PCT Pub. Date: Nov. 11, 1993

[51] Int. Cl.[6] ..... B21D 22/28

[52] U.S. Cl. ..... 72/44; 72/349

[58] Field of Search ..... 72/41, 43, 44, 72/45, 347, 349

[56] References Cited

U.S. PATENT DOCUMENTS

| | | | |
|---|---|---|---|
| 3,798,943 | 3/1974 | Benteler et al. | 72/43 |
| 4,223,544 | 9/1980 | Main | 72/45 |
| 4,881,394 | 11/1989 | Jansen | 72/45 |

FOREIGN PATENT DOCUMENTS

| | | | |
|---|---|---|---|
| 137024 | 8/1982 | Japan | 72/43 |
| 650696 | 3/1979 | U.S.S.R. | 72/41 |
| 2181082 | 4/1987 | United Kingdom | 72/349 |

*Primary Examiner*—Lowell A. Larson

*Attorney, Agent, or Firm*—Dennison, Meserole, Pollack & Scheiner

[57] ABSTRACT

Method and device for drawing and ironing a metallic or metalloplastic can by utilizing a chamber arranged for flow of lubricant therethrough, including an input opening and an output opening, and which is placed upstream of at least one drawing die. The chamber includes an annular, long and narrow, cylindro-conical antechamber located upstream of the die, adjacent to the external surface of the can which is being drawn, the antechamber having a length lo between 3 and 50 mm, and a thickness jo between 25 and 200 μm.

13 Claims, 4 Drawing Sheets

APPARATUS FOR DRAWING AND IRONING METALLIC OR METALLOPLASTIC CANS

BACKGROUND OF THE INVENTION

The invention relates to an apparatus for drawing and ironing metallic or metalloplastic cans.

During the forming of metallic or metalloplastic cans, by drawing and redrawing or drawing and ironing, two kinds of difficulties are encountered.

The first one is that Al alloys containing Mg (5000 series according to the Aluminum Association designations) have a tendency to to gall to the forming tools particularly to drawning and ironing rings (or dies). It is practically impossible to form cans with bare metal; the solution consists either to make specific surface treatments (see FR-A-2 627 189) or to coat with a plastic matter on the external or internal surface.

The first solution is relatively complex and expensive; the second one presents another difficulty which is the roll-back defect, which is more important when the height (H) over diameter (D) ratio is high and/or the thickness of the lateral wall (e) is low.

The defect is produced when the drawn receptable is extracted on the mandrel rod by the extractor. It takes the form of concertina folds in the body of the receptable, or rolling back of its free edge, or in the most serious cases of longitudinal tears in the body of the receptable and rolling of the intermediate strips into "petal" shapes. It results from a hooping effect or adhesion on the body of the receptacle to the mandrel rod during the drawing operation.

The fault is still more pronounced in cases where the drawn cans are coated internally with an organic material such as plastics; this has a spring back effect which accentuates the hooping effect.

Attempts have been made to remedy this defect in various ways, but the results obtained are still inadequate and/or uncertain:

by increasing lubrication at the can/mandrel rod interface by any known means. However, this solution has the following limitations:

It does not allow one to obtain high rates of thickness reduction and hence limitation of the drawing ratio r (e.g. to a maximum value $r=(E-e)/E\times100=20$ with $e \leqq 0.15$ mm for aluminium cans) and of the H/D value obtained.

As far as the die is concerned, improved lubrication gives a drawn external surface which is rough and dull in appearance rather than smooth and shiny, whereas the latter surface condition is most frequently required;

by using a mandrel rod made of a hard metal (tungsten carbide) instead of a steel one (modulus of elasticity 500 GPa instead of 200 GPa) ;

by using a hollow deformable mandrel rod, under high hydraulic pressure during the drawing operation, and by removing the pressure before extracting the drawn can.

However this solution is mechanically complex, difficult to implement and expensive;

by assisting extraction by the pressure of a fluid, preferably a liquid, through the mandrel rod; however the pressure is limited by the stability of the base and often proves to be inadequate for correct extraction.

SUMMARY OF THE INVENTION

Being aware of these difficulties, Applicants have sought to avoid the disadvantages described above.

A can drawing machine is essentially made up of a plurality of coaxial dies of decreasing diameters and a generally cylindrical axial mandrel rod. The mandrel rod successively pushes the blank though the dies, in which its side wall is made thinner and drawn (made longer); in present-day industrial machines the dies are generally three in number.

The apparatus according to the invention thus comprises a chamber which is located upstream of at least one of the drawing dies, in semi-impervious manner, and provided with a port for lubricant intake and a discharge port.

The essential feature of the invention is that in each chamber on the upstream side of the corresponding die (or ring), there is a antechamber formed by a long and narrow cylindro-conic annular space, near the external surface of the drawn can. This antechamber is externally limited by the die itself or by an inserted sleeve. It comprises an eventually annular cylindrical part, extending on the ring side, by a conical transition part. If lo is its total length and jo its thickness, one should preferably have:

$$25 \leqq jo \leqq 100\ \mu m$$

$$3 \leqq lo \leqq 50\ mm$$

The unexpected result is that, in the case of drawing and ironing a metalloplastic can with this apparatus placed on the last drawing die, the drawn can can easily by extracted from the mandrel rod. The equipment may be used in various ways: It may be used on the last drawing die, which produces either a considerable reduction in thickness of from 20 to 45% or a slight reduction in thickness (a skin pass) with $$1 \leqq r\% \leqq 10$$

The two uses may alternatively be combined, with an apparatus placed on the last and penultimate drawing die, which are then contiguous, and with the last die providing the skin pass. It may also be used on a plurality of successive dies.

In the case of Al series 5000 alloys drawing and ironing, the device according to the invention must be placed on all the dies.

It was observed that if:

jo<25 μm or lo<3 mm, the galling appears on bare 5000 Al alloys, and it is not possible to extract the metalloplastic drawn can.

jo>200 μm, the external surfaces are dull, which must be avoided.

lo>50 μm, the effectiveness is not improved, but also leads to more expensive tools, and essentially to larger dimensions which are not compatible with existing machines.

BRIEF DESCRIPTION OF THE DRAWINGS

The apparatus according to the invention will be understood better from the following figures.

DESCRIPTION OF THE PREFERRED EMBODIMENTS

EXAMPLE 1

Figure 1:
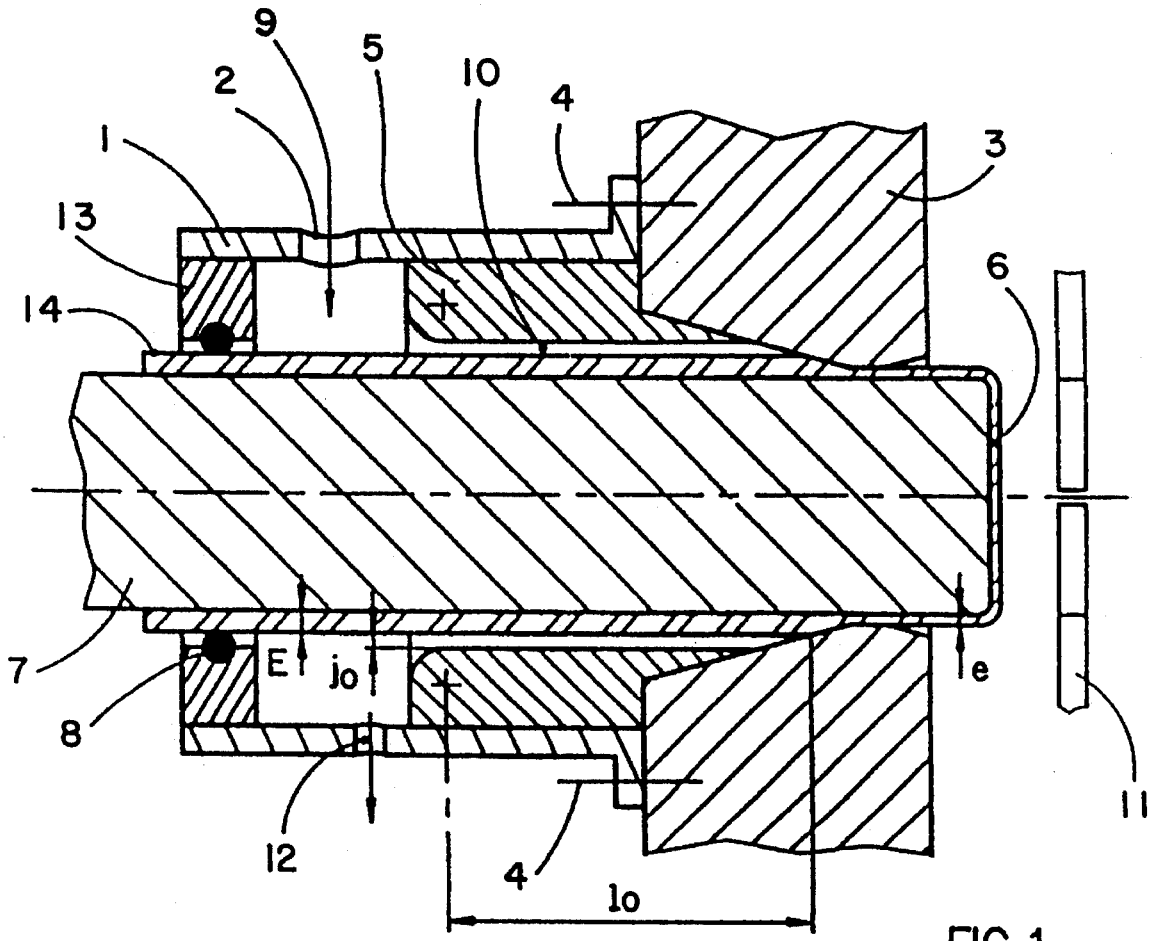
FIG. 1 represents an axial cross-sectional view of the device for drawing and ironing metalloplastic cans.

The apparatus of Example 1 comprises a chamber 1 which has a port 2 for the intake of lubricant 9 and which is fixed upstream of the drawing die 3 by screws 4 (not shown); it has a discharge port 12. The chamber is closed at the upstream end by a wall 13 and contains a sleeve 5. The sleeve 5 bounds an annular space 10 of a thickness jo and a length 10 together with the external surface 14 of the can 6 being drawn, which is on the mandrel rod 7. Reference numeral 11 indicates the extractor.

The apparatus may, for example, be completed by an O-ring seal 8 located between the chamber 1 and the wall 14 of the receptacle 6. The wall 13 may be replaced by the guiding ring (not shown) located behind the upstream die, and having a positive clearance of some hundredths of a millimeter from the external surface of the body of the can.

The above apparatus was used under the following conditions on a machine equipped with 3 drawing dies, the apparatus being mounted upstream of the third die.

The mandrel rod is made of tungsten carbide with an arithmetic rugosity Ra of 0.10 μm. The receptacle to be drawn has a composite wall made up of aluminium 3004 on the outside (initial thickness 0.339 mm); coated internally with PP (initial thickness O.040 mm), giving a total thickness of 0.375 mm. The lubricant used is demeneralised water with 0.05% of a surfactant product, FORAFAC 1110 (Atochem) added to it; its delivery rate is 0.17 l/sec.

The drawing ratio was 30.6% at the first die, 28,8% at the second and variable at the third.

Figure 2:
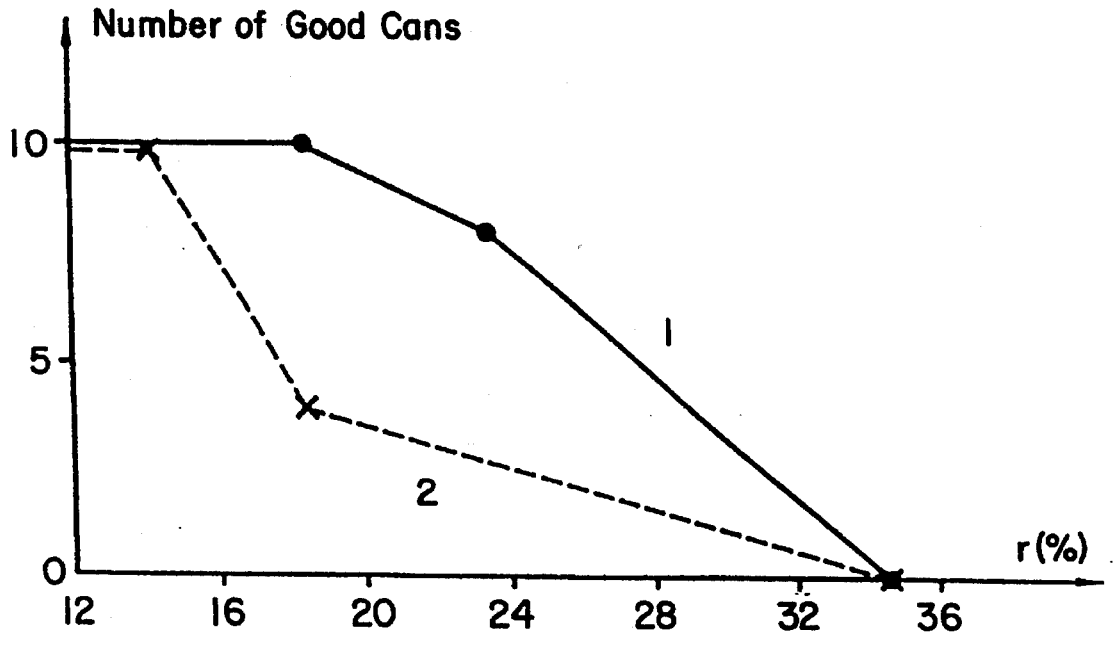
FIG. 2 is a graph of the results of Example 1.

The value jo and lo were fixed as 20 μm and 50 mm respectively. Mandrel rod speed: 1350 m/sec. Comparative tests were carried out under the same conditions except that the sleeve 5 had been removed. Comparative results for the number of cans (N) extracted undamaged in a series of 10 tests are given in FIG. 2, for the method of the invention (1) and prior art (2), as a function of the drawing ratio of the third die (r%). It will be seen that the proportion of cans correctly extracted has more than doubled over prior art.

EXAMPLE 2

Tests similar to Example 1 above were carried out, using only one apparatus according to the invention at a fourth drawing die, which produced a reduction in thickness of 7.5% (skin pass of 10 μm). The successive drawing ratios were thus as follows : 80.6%; 28.8%; 30%; 7.5%. All the cans can be extracted without difficulty at a mandrel rod speed of 1350 or 2250 m/sec.

EXAMPLE 3

Figure 3:
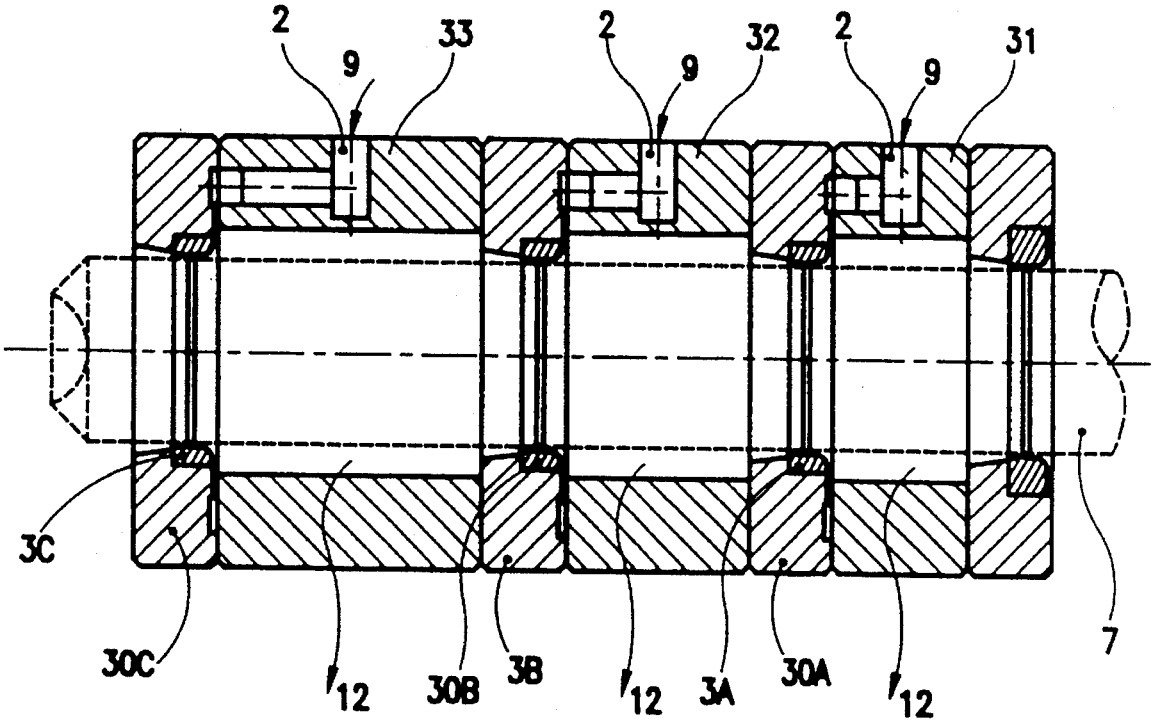
FIG. 3 represents cross-sectional view of the device used for drawing and ironing 5000 series Al alloys disclosed is (Example 3)
Figure 4:
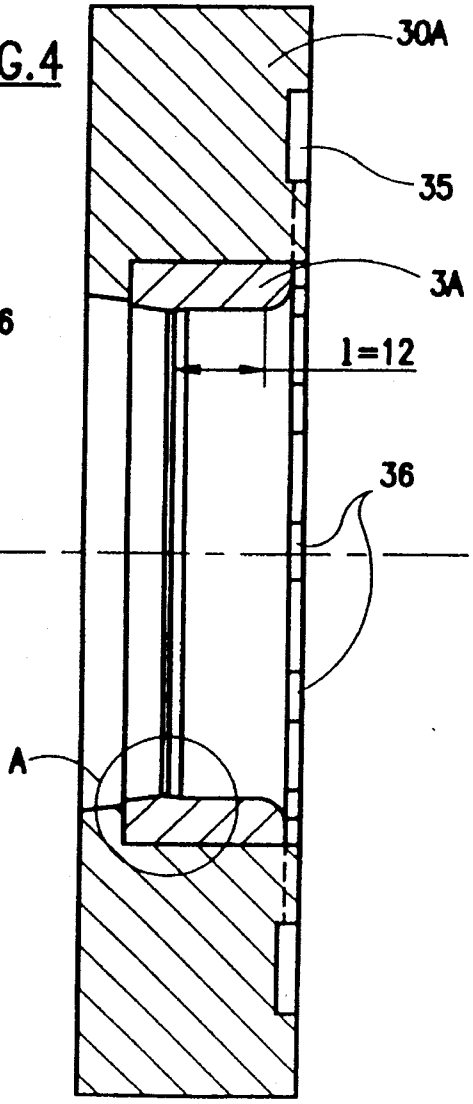
FIG. 4 represents a cross-sectional view of the die and die bearer of FIG. 3.
Figure 5:
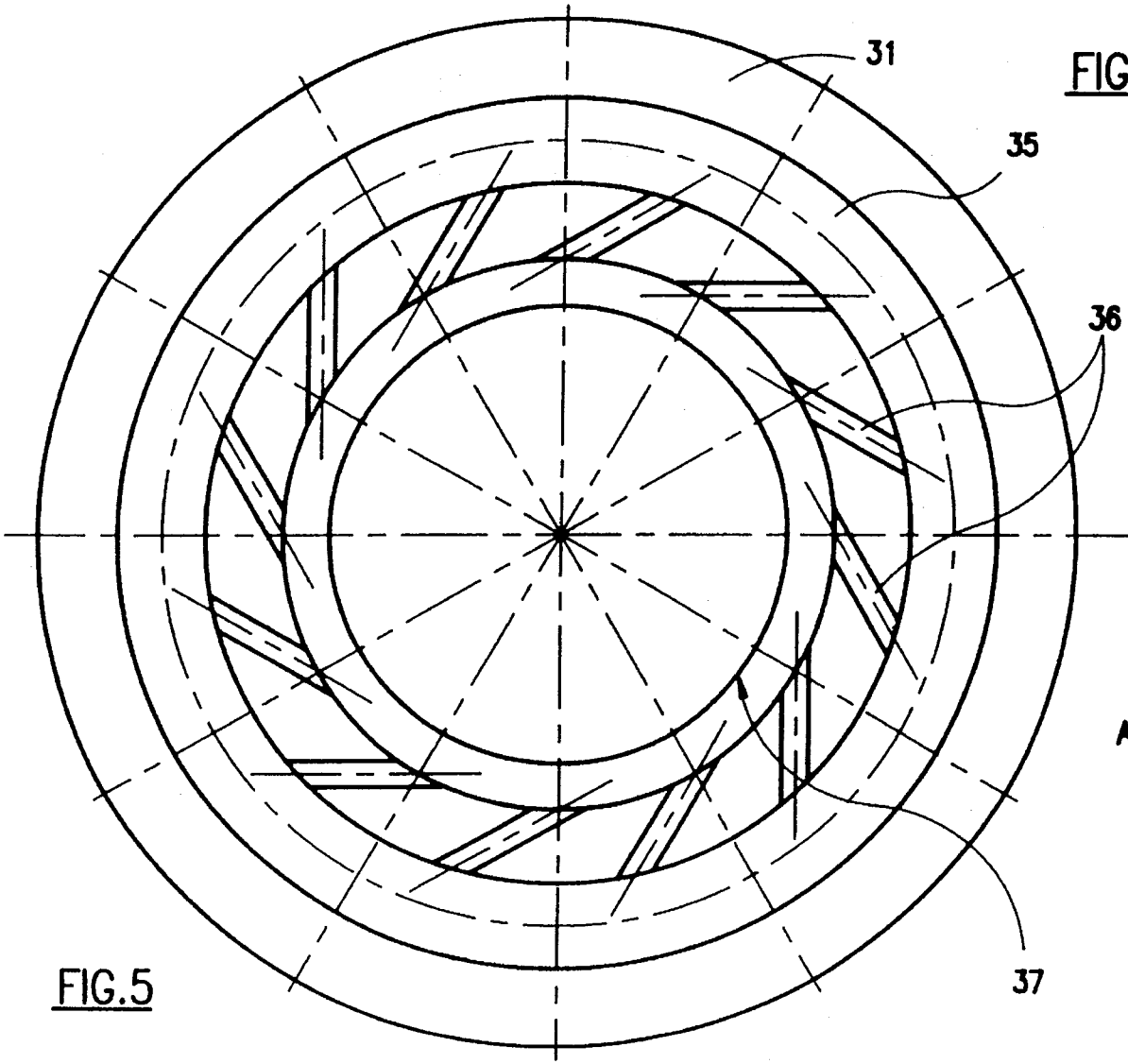
FIG. 5 is a side view of the FIG. 4.

This test relates to drawing and ironing of 5182 cans. The used device used, shown in FIG. 3, comprises 3 tungsten carbide dies 3A, 3B, 3C in the bearers 30A, 30B, 30C and separated by sleeves 31, 32, 33 of increasing lengths. In the course of drawing, the can is always in contact with 2 successive dies. Each sleeve has an port 2 for lubricant 9 and an output for lubricant (not shown). The mandrel 7 is in dotted lines. The bearer 31 (or 32 or 33) includes, as shown in FIG. 4, a lubricant distribution ring 35, with distribution channels 36, substantially in the tangential direction to the opening 37 of the die 3A.

The annular antechamber, object of the invention, used in this test has a cylindrical length of 12 mm (FIG. 4), and a thickness j (FIG. 6) of 85 μm for 3A, 112 μm for 3B and 120 μm for 3C.

The tests were made with 5182 alloy at the H19 temper, in 0.3 mm thickness, the chemical content being (in weight %).

| Si | Fe | Cu | Mn | Mg | Cr | Ni | Zn | Ti | Zr |
|---|---|---|---|---|---|---|---|---|---|
| 0.13 | 0.25 | 0.01 | 0.33 | 4.5 | 0.02 | <0.05 | 0.01 | 0.01 | <0.05 |

The tensile properties were:

Rm=390 MPa–Ro.2=328 MPa and A=9.8%

The mandrel diameter was 65.670 mm and die diameters respectively 66.290 mm (3A) ; 66.137 mm (3B) and 65.979 mm (3C). The lubricant stream was 96 l/min shared at 32 l/min for each die. The lubricant was water added with NALCO XL174 at 3% (in vol)—product of NALCO Co at 40° C. The strokes were at 280/min with a body—maker CMB B4 type.

Figure 6:
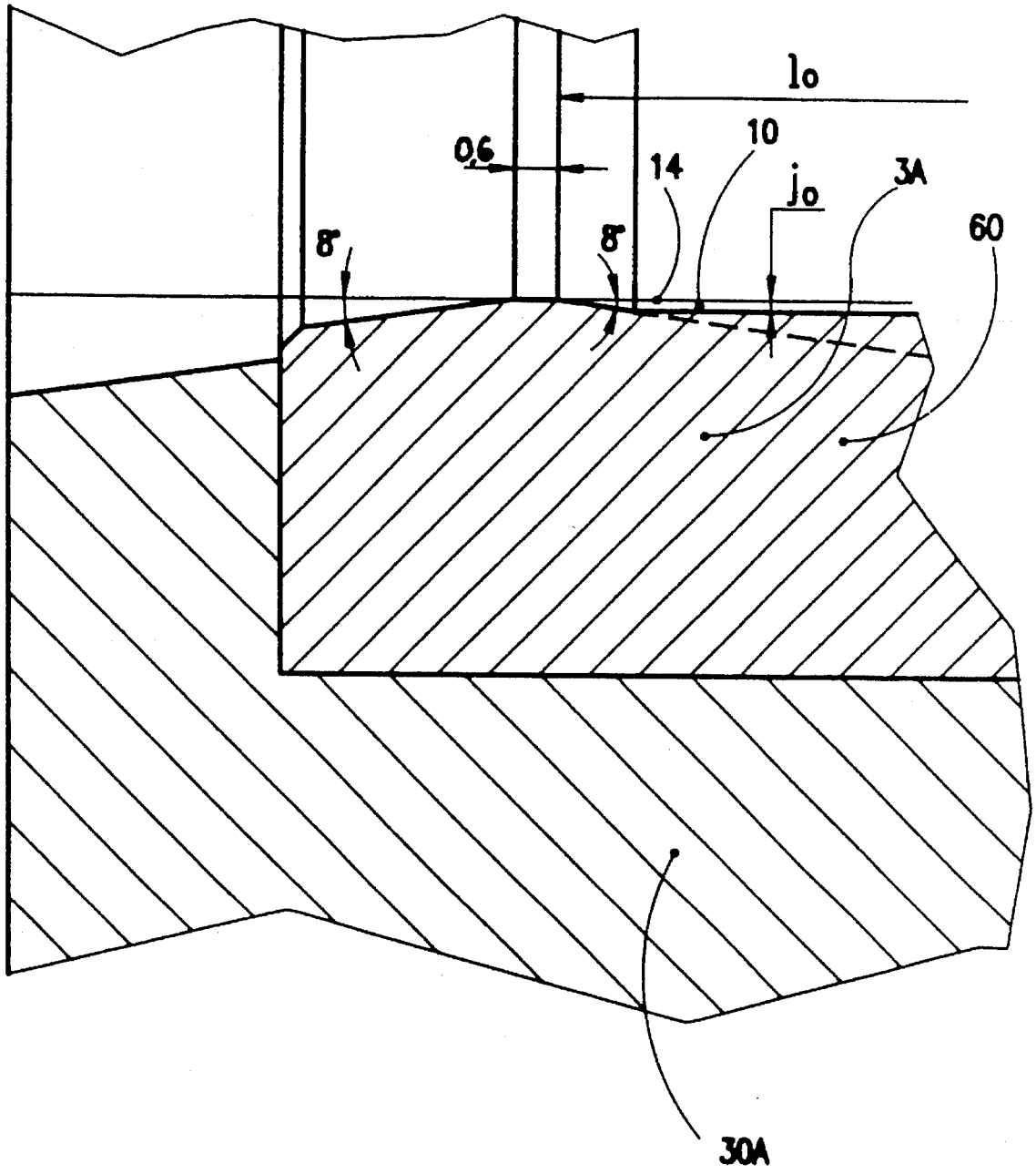
FIG. 6 is an enlarged view of detail A of FIG. 4.

Comparative tests were made under the same conditions, except that the classical dies used do not present an annular cylindrical zone, but a conical part at 8° (half top angle) as shown at 60 on FIG. 6.

Under these conditions, it was possible to draw, with the invention device, more than 20000 cans a day (with 2 intermediate stops) without galling; the drawing of 5182 cans with classical dies is not possible.

The apparatus according to the invention has the advantage that it can easily be mounted on existing drawing machines and will enable them:

either to produce receptable with higher H/D ratios and/or smaller thicknesses e;

or to use stronger materials with thinner walls, thus economizing in raw materials.

Thus it is possible to use 3000 alloys which are more alloyed than 3004, 3104 or ever alloys of the 5000 series such as 5182 (as defined by the Aluminum Association).

What is claimed is:

1. Device for drawing and ironing a metallic or metalloplastic can having an external surface comprising a chamber arranged for flow of lubricant therethrough including an input opening and an output opening, and which is placed upstream of at least one drawing die, wherein said chamber comprises an annular, long and narrow, cylindro-conical antechamber located upstream of said at least one die, adjacent to the external surface of the can which is being drawn, said antechamber having a length lo between 3 and 50 mm, and a thickness jo between 25 and 200 μm.

2. Device according to claim 1 wherein the antechamber is limited externally by the die.

3. Device according to claim 1 wherein the antechamber is limited externally by a inserted sleeve.

4. Device according to claim 3, wherein the chamber is closed by a wall with a seal which is in contact with the external surface of the.

5. Device according to claim 4 wherein the wall of the chamber is a guidance ring of an upstream die.

6. In a method of drawing and ironing a metallic or metalloplastic can having an external surface comprising drawing a can with a plurality of drawing dies in series and concluding with a last drawing die, the improvement comprising placing upstream of at least one die a device comprising a chamber having a lubricant input opening and a lubricant output opening and including an annular, long and narrow, cylindro-conical antechamber upstream of said at least one die adjacent to the external surface of the can which is being drawn, the antechamber having a length lo between 3 and 50 mm and a thickness jo between 25 and 200 μm, and causing lubricant to flow through the chamber between the input and the output during drawing of the can.

7. Method according to claim 6 wherein the lubricant consists essentially of water.

8. Method according to claim 6, wherein the can undergoes a penultimate drawing with a reduction between 20 and 45% and a final reduction between 1 and 10%.

9. Method of drawing and ironing according to claim 6 wherein the penultimate die and the last die are adjacent.

10. Method according to claim 6 wherein the can is formed of a 5000 series Al alloy and the device is placed on all the dies.

11. Method according to claim 6, wherein said device is placed at least directly upstream of the last die of said series.

12. Method according to claim 15, wherein the can undergoes a reduction r between 20 and 45% in the last die.

13. Method according to claim 11, wherein the can undergoes a reduction r between 1 to 10% in the last die.

* * * * *

UNITED STATES PATENT AND TRADEMARK OFFICE

CERTIFICATE OF CORRECTION

PATENT NO. : 5,460,024

DATED : October 24, 1995

INVENTOR(S) : RENE MENEGHIN et al

It is certified that error appears in the above-identified patent and that said Letters Patent is hereby corrected as shown below:

Column 3, line 36, change "0.339" to --0.335--.
Column 3, line 59, change "80.6" to --30.6--.
Column 3, line 65, delete "used" (first occurrence).

Signed and Sealed this

Twenty-third Day of January, 1996

*Attest:*

Bruce Lehman

BRUCE LEHMAN

*Attesting Officer*

*Commissioner of Patents and Trademarks*